US008276777B2

(12) United States Patent
Shieh et al.

(10) Patent No.: US 8,276,777 B2
(45) Date of Patent: Oct. 2, 2012

(54) CLOSURE WITH TAMPER EVIDENT STRIP FOR CONTAINER

(76) Inventors: Chuck Shieh, Millburn, NJ (US); Lan Liu, Millburn, NJ (US)

( * ) Notice: Subject to any disclaimer, the term of this patent is extended or adjusted under 35 U.S.C. 154(b) by 342 days.

(21) Appl. No.: 12/459,868

(22) Filed: Jul. 9, 2009

(65) Prior Publication Data

US 2010/0084399 A1 Apr. 8, 2010

Related U.S. Application Data

(60) Provisional application No. 61/102,383, filed on Oct. 3, 2008.

(51) Int. Cl.
*B65D 17/353* (2006.01)
*B65D 43/16* (2006.01)
*B65D 17/28* (2006.01)

(52) U.S. Cl. ..... 220/259.2; 220/254.2; 220/254.3; 220/270

(58) Field of Classification Search ..... 220/259.2, 220/270, 526, 524, 553, 254.2, 254.3
See application file for complete search history.

(56) References Cited

U.S. PATENT DOCUMENTS

| | | | | |
|---|---|---|---|---|
| 3,155,285 | A * | 11/1964 | Van Baarn | 222/153.06 |
| D200,270 | S | 2/1965 | Waterman | |
| D204,509 | S | 4/1966 | Waterman | |
| 3,255,928 | A | 6/1966 | Foster | |
| 3,469,732 | A * | 9/1969 | Foster | 220/835 |
| 4,463,869 | A * | 8/1984 | Lewis | 220/269 |
| 4,592,480 | A * | 6/1986 | Hart et al. | 220/270 |
| 4,610,371 | A | 9/1986 | Karkiewicz | |
| 4,619,370 | A | 10/1986 | Agbay | |
| 4,621,744 | A | 11/1986 | Foster | |
| 4,658,980 | A | 4/1987 | Lindstrom | |
| 4,709,823 | A | 12/1987 | Beck | |
| 4,711,363 | A | 12/1987 | Marino | |
| 4,724,972 | A | 2/1988 | Marcus | |
| 4,724,977 | A | 2/1988 | Cleevely | |
| 4,787,530 | A | 11/1988 | Edwards | |
| 4,852,751 | A | 8/1989 | Halfacre | |
| 4,986,430 | A | 1/1991 | Dutt | |
| 5,052,572 | A | 10/1991 | Pherigo | |
| 5,090,583 | A | 2/1992 | Hoffman | |
| 5,114,068 | A * | 5/1992 | Reil et al. | 229/123.2 |
| 5,123,561 | A | 6/1992 | Gross | |
| 5,147,054 | A | 9/1992 | Pehr | |
| 5,170,905 | A | 12/1992 | Luch | |
| 5,219,087 | A | 6/1993 | Christensson | |
| 5,303,837 | A | 4/1994 | Adams | |
| 5,348,184 | A | 9/1994 | Adams | |
| 5,356,019 | A | 10/1994 | Kelly | |

(Continued)

FOREIGN PATENT DOCUMENTS

| | | |
|---|---|---|
| WO | WO 95/22494 | 8/1995 |

(Continued)

*Primary Examiner* — Mickey Yu
*Assistant Examiner* — Niki Eloshway
(74) *Attorney, Agent, or Firm* — Gerhart Law, LLC

(57) ABSTRACT

The present invention is a tamper evident closure for containers. The tamper evident closure is a perforated strip that is releasably attached to lids on the base. When the lid of the closure is opened, the strip is torn from the lids, thereby indicating that the item has been tampered with. The invention is manufactured to be employed on commonly available containers for food and personal care items.

16 Claims, 7 Drawing Sheets

U.S. PATENT DOCUMENTS

| | | | | |
|---|---|---|---|---|
| 5,512,228 | A | 4/1996 | Adams | |
| 5,617,968 | A | 4/1997 | Luburic | |
| 5,626,251 | A | 5/1997 | Luburic | |
| 5,678,718 | A | 10/1997 | Morris | |
| 5,678,719 | A | 10/1997 | Adams | |
| 5,887,736 | A | 3/1999 | Mar | |
| 5,996,824 | A | 12/1999 | Grant | |
| 6,119,898 | A | 9/2000 | Dark | |
| 6,302,301 | B1 * | 10/2001 | Vette | 222/142.6 |
| 6,347,716 | B1 | 2/2002 | Nofer | |
| 6,386,358 | B1 | 5/2002 | North | |
| 6,419,101 | B1 | 7/2002 | Hessel | |
| 6,422,411 | B1 | 7/2002 | Gray | |
| D464,886 | S | 10/2002 | Bried | |
| 6,460,266 | B1 | 10/2002 | Painter | |
| D466,408 | S | 12/2002 | Baerenwald | |
| D467,801 | S | 12/2002 | Baerenwald | |
| 6,543,268 | B2 | 4/2003 | Wright | |
| D474,402 | S | 5/2003 | Baerenwald | |
| 6,648,631 | B2 | 11/2003 | Wright | |
| D495,256 | S | 8/2004 | Solowiejko | |
| 6,848,603 | B2 | 2/2005 | Gaiser | |
| D513,584 | S | 1/2006 | Solowiejko | |
| 7,021,482 | B2 | 4/2006 | Solowiejko | |
| D523,743 | S | 6/2006 | Solowiejko | |
| 7,114,627 | B2 | 10/2006 | Solowiejko | |
| 7,913,868 | B2 * | 3/2011 | Dolan et al. | 220/254.2 |
| 2004/0011829 | A1 | 1/2004 | Gaiser | |
| 2006/0011573 | A1 | 1/2006 | Herald | |
| 2006/0138136 | A1 * | 6/2006 | Frey et al. | 220/254.3 |
| 2006/0186078 | A1 | 8/2006 | Ziegenhorn | |
| 2006/0186079 | A1 | 8/2006 | Ziegenhorn | |
| 2009/0101645 | A1 * | 4/2009 | Wilson et al. | 220/254.2 |
| 2009/0101674 | A1 * | 4/2009 | Newberry et al. | 222/153.07 |

FOREIGN PATENT DOCUMENTS

| | | |
|---|---|---|
| WO | WO 98/19920 | 5/1998 |
| WO | WO 2006/020059 A2 | 2/2006 |
| WO | WO 2006/024656 A1 | 3/2006 |

* cited by examiner

CLOSURE WITH TAMPER EVIDENT STRIP FOR CONTAINER

CLAIM OF PRIORITY

This application claims priority to U.S. Ser. No. 61/102,383 filed Oct. 3, 2008, the contents of which are fully incorporated herein by reference.

FIELD OF THE INVENTION

The invention relates to closures for containers, in particular, tamper evident closures.

BACKGROUND OF THE INVENTION

Dispensing plastic closures have come into widespread use by virtue of the convenience by which they permit consumers to readily manipulate the closure for dispensing contents from an associated container. This type of closure typically includes a closure body for fitment to the associated container, with the body defining one or more dispensing openings through which the contents of the container can be dispensed. This type of closure further includes a flip-top lid pivotally joined to the closure body, such as by a flexible hinge, so that the lid can be moved between open and closed positions with respect to the closure body, thereby opening and closing the dispensing opening.

It is desirable to provide this type of dispensing closure with a tamper-indicating or tamper-evident feature, whereby consumers can readily visually discern whether the flip-top lid of the closure has been previously opened. While it is known to provide separate seal elements or the like applied to such closures for tamper-indication, the use of such additional sealing elements complicates closure manufacture. It is thus desirable to configure such a dispensing closure to include an integral tamper-indicating arrangement. At the same time, it is desirable that such a tamper-indicating arrangement functions without undue complexity, and avoid the need to separate one or more loose components of the closure during initial opening.

The present invention is directed to a one-piece tamper-indicating dispensing closure which can be economically manufactured, is reliable in operation, is easily and conveniently manipulated by consumers, and avoids separation of any loose components during initial opening of the closure. Although prior art for similar closures exists, none of the prior art teaches the present invention.

U.S. Pat. No. 3,255,928 teaches a so-called tamperproof container having a wall member with a dispensing opening therein and a closure member which, as initially assembled on the wall member, is held in a position closing the dispensing opening by an element which must be torn away to release the closure member for service use but, if the tearing is by an unauthorized person, leaves visible evidence of the tampering.

U.S. Pat. No. 4,658,980 teaches a container cap comprising a cover member, at least one opening in the cover member, lid means including at least one lid to close said opening, flexible hinge means connecting the lid means to the cover member, and defining a free edge opposite said hinge means, and tamper evidencing means in the form of arrowhead locks positioned at opposite corners of said free edge secured to the cover member, including breakable webbing connecting said locks to said lid means.

U.S. Pat. No. 6,347,716 teaches a flip top closure has a tamper evident flap and is used on a container with a neck and an opening therein. The neck has an outer surface with retaining means for the closure thereon. The closure has two sections that are hinged to one another and with each section having a lip extending along an edge thereof. When the closures are in a closed position, the two lips form a continuous line of contact with one another and a flap extends across the line of contact. The flap is connected to one section by ultrasonic spot welding. The flap is severable from either or both sections. When the closure is opened the flap separates from one of the sections.

U.S. Pat. No. 4,592,480 teaches a tamper evidencing cap for use with containers for ingestibles, medicines, and the like. The cap comprises first and second cover members connected to each other. At least one lid is hinged to the second cover member for movement between open and closed positions. Tamper evidencing means is removably connected to and between the lid and one of the cover members to prevent the lid from opening until the tamper evidencing means is removed. The cap may additionally or alternatively include a further tamper evidencing means comprising a skirt that extends from the periphery of the first cover member for engaging a side surface of the container. The skirt has a plurality of spaced apart weakened zones around its periphery.

US Publication 20060011573 teaches a tamper-indicating dispensing closure includes a closure body, and an associated flip-top lid pivotally connected to the closure body for movement between a closed position and an open position. The flip-top lid includes a tamper-indicating flange frangibly connected thereto, with the closure body including a pocket-like retention cavity within which the tamper-indicating flange is received during initial closing movement of the flip-top lid. During initial opening movement of the lid, the tamper-indicating flange is broken away from the flip-top lid, and thereafter permanently retained within the retention cavity to provide a clear, visual indication that the flip-top lid of the closure has been opened.

The present invention is comprised of a closure which is easy and relatively to manufacture. The closure has a tamper-proof feature which is on the outside of the container lid, thereby making it more visible before purchase than tamper-proof devices which are inside a container lid. Additionally, if the tamper-proof feature is altered or removed from the closure, it is very evident upon visual inspection.

Embodiments of this invention are illustrated in the accompanying drawings and will be described in more detail herein below.

SUMMARY OF THE INVENTION

The present invention is an article of manufacture, a closure having a lid assembly and a base assembly. The base assembly has a base wall, the lid assembly has at least one hinged lid hinged to the base assembly. A tamper evident strip is breakably attached to the lid, where the tamper evident strip has a center strip and an angled tear strip secured to the center strip.

It is an object of the invention to provide a lid with closure for food items.

It is an object of the invention to provide a tamper evident closure for food items.

It is an object of the invention to provide a tamper evident closure for personal care items.

It is an object of the invention to provide a tamper evident closure for food and personal care items in which tampering is visually obvious, preferably before purchase.

It is an object of the invention to provide a cost effective tamper evident closure for food and personal care items.

It is an object of the invention to provide an easily manufactured tamper evident closure for food and personal care items.

It is an object of the invention to provide a tamper evident closure that will adhere to plastic and metal containers.

DESCRIPTION OF THE PREFERRED EMBODIMENTS

Figure 1A:
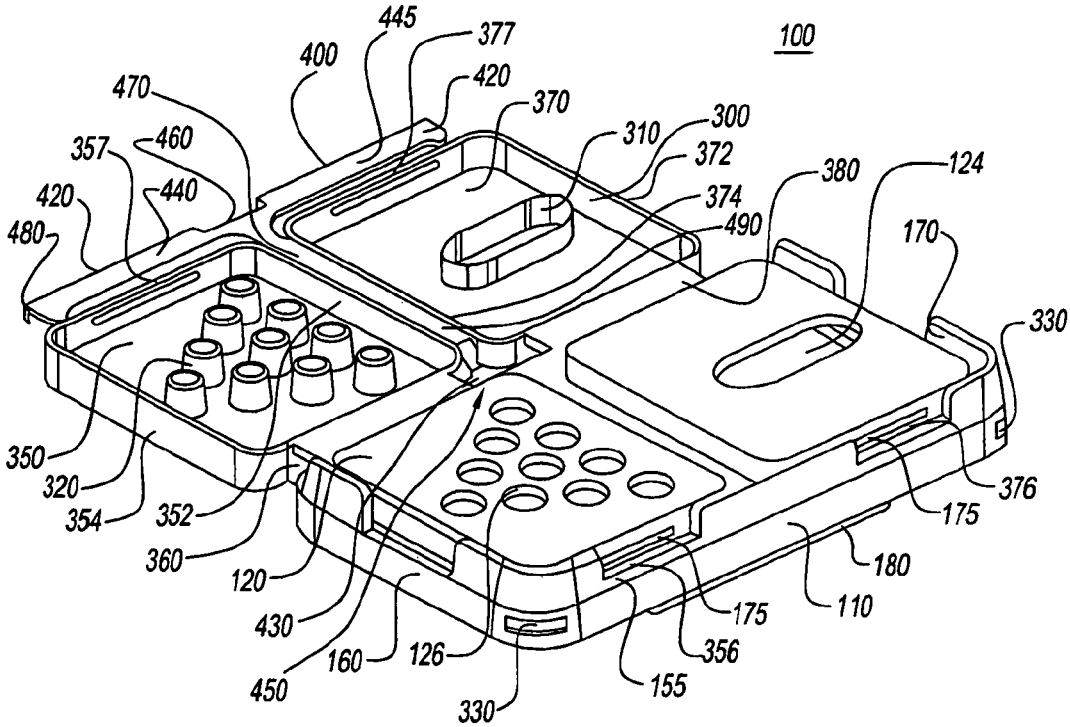
FIG. 1 is a top perspective view of a preferred embodiment of the invention in both open and closed configurations, where the closures is adapted for use on a plastic container.

The preferred embodiments of the present invention will now be described with reference to FIGS. 1-9 of the drawings. Identical elements in the various figures are identified with the same reference numerals.

Figure 1B:
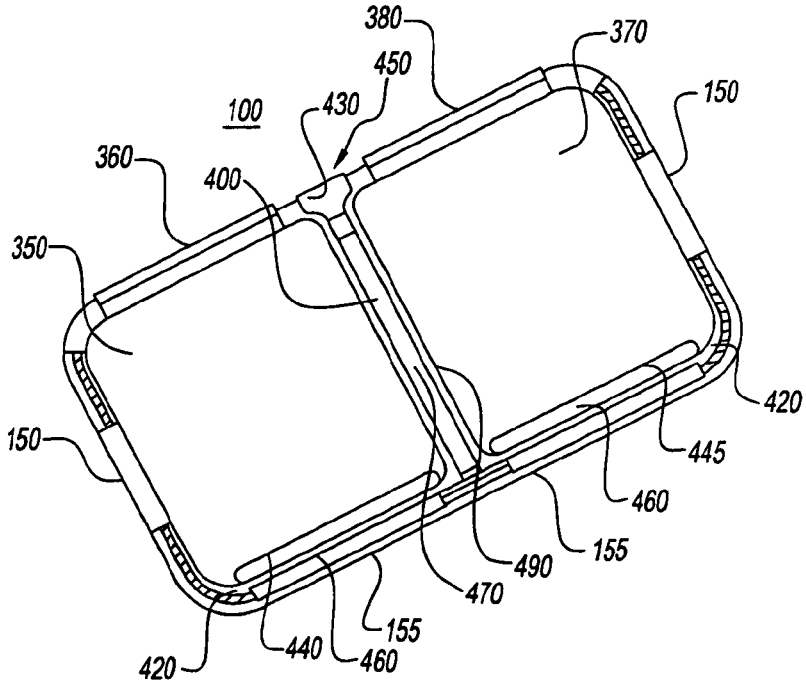

FIG. 1 shows the closure. This version of the closure is especially adapted for use with a plastic container. FIG. 1 has two parts: FIG. 1*a* is a top perspective view of the closure in the open configuration. FIG. 1*b* is a top perspective view of the closure in the closed configuration.

FIG. 1*a* shows the closure 100, base assembly 110, base assembly top surface 120, base assembly top surface pouring hole 124, base assembly top surface sprinkling hole 126, base wall front 155, base wall left 160, base wall inside surface 170, base wall reveal 175, base support edge 180, lid assembly 300, lid pouring hole plug 310, lid surface sprinkling hole plugs 320, and barbed hook inlet 330.

Also shown in FIG. 1*a* is first lid 350, first lid right edge 352, first lid left edge 354, first lid capture lip 356, first lid capture lip catch 357, first lid hinge 360, second lid 370, second lid right edge 372, second lid left edge 374, second lid capture lip 376, second lid capture lip catch 377, and second lid hinge 380.

FIG. 1*a* shows tamper evident strip 400, with tamper evident strip flex point 420, tamper evident strip pull 430, tamper evident strip first portion 440, tamper evident strip second portion 445, tamper evident strip back portion 450, angled tear strip 460, center strip 470, angled tear strip perforation 480, and center strip perforation 490.

FIG. 1*a* shows the tamper evident strip 400 in place on the opened closure. For a sealed closure 100 to be opened, the tamper evident strip 400 must be removed or the user will not be able to open the lids 350 and 370.

FIG. 1*b* shows the closure 100 in the closed configuration. Illustrated in FIG. 1*b* is base wall 150, base wall front 155, first lid 350, first lid hinge 360, second lid 370, and second lid hinge 380.

FIG. 1*b* also shows tamper evident strip 400, with tamper evident strip flex point 420, tamper evident strip pull 430, tamper evident strip first portion 440, tamper evident strip second portion 445, tamper evident strip back portion 450, angled tear strip 460, center strip 470, and center strip perforation 490.

The base assembly 110 has a base wall 150 having front, left and right sides. The base wall front side further has an inside surface.

The base assembly 110 has base assembly top surface 120, with a pouring hole 124, and sprinkling holes 126 for dispensing product. The pouring hole 124 may be any size or shape, and may be placed anywhere on the base. The sprinkling holes 126 may be any size or shape, and may be placed anywhere on the base. There may be any number of sprinkling or pouring holes, with a preferred embodiment being one pouring hole and at least two sprinkling holes, with one sprinkling hole about 30% larger than the other sprinkling holes. The width of the pouring and/or sprinkling holes may range from ½ millimeter to 30 centimeters, with a preferred width for a sprinkling hole of less than 3 mm.

The base wall reveal 175 provides an easy access for a finger tip to flip open the lids. The base hooked edge 180 facilitates the base assembly 110 being sealed to a container such that the closure 100 may be securely fastened to a container. This feature of the invention will be discussed in more detail when describing FIG. 4.

The lid assembly 300 has a pouring hole plug 310, and sprinkling hole plugs 320 for keeping material inside a container contained when not in use. Although shown with two lids, the invention may be made with only one lid, or with any number of lids.

The pouring hole plug 310 and sprinkling hole plugs 320 correspond to the pouring hole 124 and sprinkling holes 126, such that they plug the holes when the lids 350 and 370 are closed onto the base assembly 110 of the closure 100. As illustrated, each base hole has a corresponding plug; this may vary. There may be fewer plugs than holes, or there may be no plugs, and the inner lid surface of the closure may be flat.

The first lid capture lip catch 357 conforms to the shape of the first lid capture lip 356, and the second lid capture lip catch 377 conforms to the second lid capture lip 376, such that when the lids are closed after their initial opening, the lids are releasabley held to the base assembly 100. The capture lips and capture lip catches may be any size or shape, as long as they serve the purpose to keep the closure 100 from opening when they are engaged.

FIG. 1 also shows the tamper evident strip 400. The tamper evident strip 400 has a tamper evident strip flex point 420, which allows the tamper evident strip first portion 440 and tamper evident strip second portion 445 to bend up and fold over the first lid 350 and second lid 370, respectively. The lids can not be opened with the tamper evident strip in place, because one can not pull the tamper evident strip first portion 400 and/or tamper evident strip second portion 445 off of their respective lids, since they are held flush against the base wall inside surface 170.

When a user wishes to open the lids of the closure, the user grasps the tamper evident strip 400 by the tamper evident strip pull 430, and pulls the tamper evident strip forward. This action rips apart the perforations, and the tamper evident strip tears away from the lids 350 and 370, leaving behind torn spaces on the lids, thus warning a consumer that the closure has been tampered with.

The angled tear strip perforations 480 and the center strip perforations 490 can be of any type or configuration consistent with the purposes of the invention. The tamper evident strip perforations tear away when a minimal amount of force is applied to the tamper evident strip pull 430. Therefore, the tamper evident strip perforations can be any suitable shape or size. The number of perforations can range anywhere from 2 to 10 for each lid\tamper evident strip combination. In a preferred embodiment of the invention, the each lid has four to eight perforations connecting it to the tamper evident strip 400. The perforations may be spaced in any manner, for example, they may be placed in a pattern which alternates on either side of the tamper evident strip 400.

The tamper evident strip 400, as shown in the figures is thin and linear in shape, and is parallel to the side of the container 210 and perpendicularly oriented to the front of the container 210. It is preferably placed between two lids of the closure. However, the tamper evident strip 400 could have variations shape, such as an elongated triangle, or slightly rounded rather than perfectly straight edges. Also, tamper evident strip 400 may is shown with one tamper evident strip flex point 420, but it may have one or more flex points, which allow it to bend.

Figure 2:
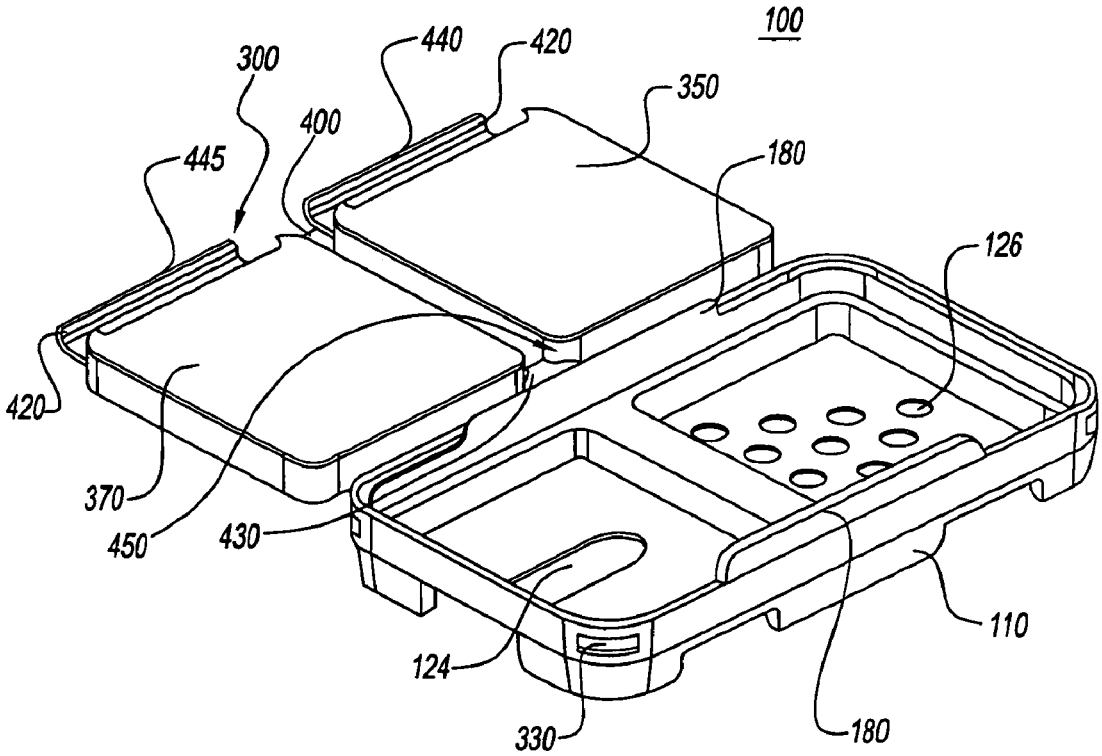
FIG. 2 is a bottom perspective view of a preferred embodiment of the invention in an open configuration.

FIG. 2 is a bottom perspective view of the closure in the opened configuration. FIG. 2 shows the closure 100, with base assembly 110, base assembly top surface pouring hole 124, base assembly top surface sprinkling hole 126, lid assembly 300, barbed hook inlet 330, first lid 350, and second lid 370. Also shown is tamper evident strip 400 with tamper evident strip flex point 420, tamper evident strip pull 430, tamper evident strip first portion 440, tamper evident strip second portion 445, and tamper evident strip back portion 450.

Although the tamper evident strip pull 430 is shown on the tamper evident strip back portion 450 in the figures, it may also be disposed on the tamper evident strip front portion 440 or anywhere feasible on the tamper evident strip.

The container may be any shape, with the closure 100 a complimentary shape so that the two elements may be securely fastened together. The container and closure 100 may be made of the same or differing materials.

The closure of the present invention is preferably, but not necessarily, molded in one piece. The closure 100 may be injection molded, or may be manufactured using any suitable method. Preferably, the closure of the present invention is made of a hard, resilient plastic, such as polypropylene; the container may be made out of a metal, such as tin or aluminum, or plastic, such as polypropylene. The particular type of polypropylene used depends on many factors, such as elasticity, (needed for proper operation of hinges), hardness for strength, cost, etc.

Although polypropylene plastic is preferred for the closure of the present invention, it may be manufactured from any material, including but not limited to, plastics, thermoplastics, elastomers, rubbers, paper or paper products, wood or wood products including but not limited to cardboard, glass or glass products, metals, composites, or any combination of these materials or suitable materials which may become available in the future.

Figure 3:
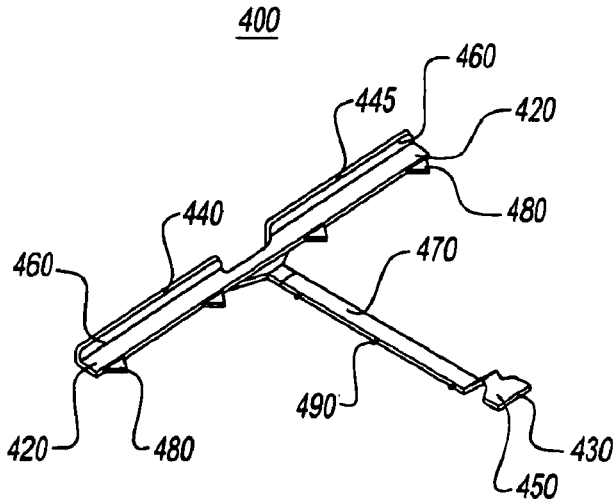
FIG. 3 is an exploded view of the tamper evident strip portion of the invention.

The tamper evident strip 400 is shown in FIG. 3 with the tamper evident strip flex point 420, the tamper evident strip pull 430, tamper evident strip first portion 440, tamper evident strip second portion 445, tamper evident strip back portion 450, angled tear strip 460, and center strip 470, angled tear strip perforations 480 and center strip perforations 490.

FIG. 3 illustrates how the tamper evident strip flex point 420 allows the angled tear strip 460 to flex to abut against an inside surface of the base wall.

The flex point 420 allows the first portion 440 and second portion 445 of the angled tear strip 460 to bend up and be held flush between the inside surface of the base wall 150 and a front edge of the lid, wherein said angled tear strip 460 covers the top of each lid when the lids are closed but before the angled tear strip 460 is removed by a user.

Figure 4A:
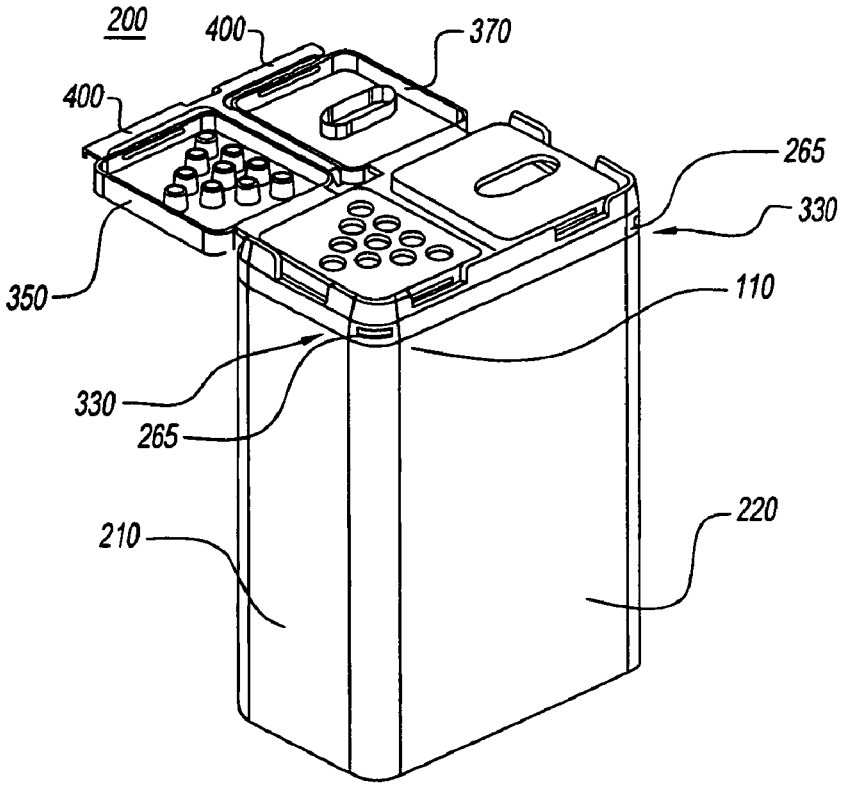
FIG. 4 is a top perspective view of the invention disposed on a plastic container in both open and closed configurations.
Figure 4B:
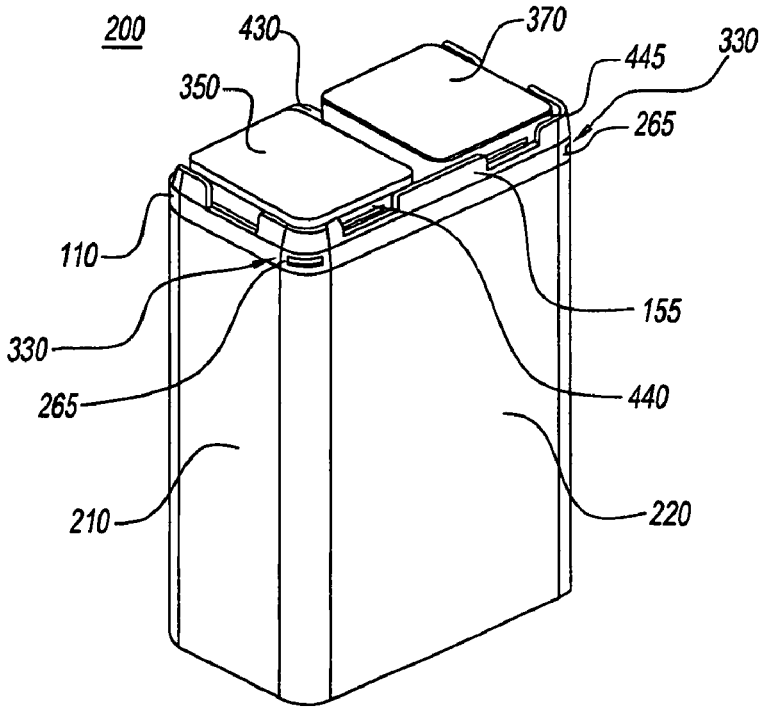

FIG. 4 has two components; FIG. 4*a* shows a front perspective view of an opened closure disposed on a container. FIG. 4*b* is a front perspective view of a closed closure disposed on a container. The details of the closure in these configurations have been discussed in detail in FIG. 1.

FIG. 4*a* shows the closure disposed on a container 200, the base assembly 110 with barbed hook inlet 330 joined with container barbed hook catch 265. Also shown is container 210, container front 220, first lid 350, second lid 370, and tamper evident strip 400. As noted before, the tamper evident strip is shown intact on the open closure for illustrative purposes only, and would not be intact on a closure opened by a consumer.

FIG. 4*b* shows the closure disposed on a container 200, with base wall front 155, container 210, container front 220, the base assembly 110 with barbed hook inlet 330 joined with container barbed hook catch 265, first lid 350, second lid 370, tamper evident strip pull 430, tamper evident strip first portion 440, and tamper evident strip second portion 445.

The container 210 as shown is a rectangular container typically used to contain spices, however, the container of the present invention can be of any suitable configuration such as but not limited to, cylindrical, square, or oval in nature. It can be a container used for spices or for any other product, such as but not limited to, medicines, any type of food or food product, personal care products, such as but not limited to, eye drops, contact lens solutions, shampoos, baby powders, etc. having various dimensions and the volumes of 2 to 32 oz.

As can be seen in most of the figures, the base assembly has hooked edges, which adhere the base assembly to a container with a top edge that has conforming hooked edges. The configuration of this invention allows the closure to be used with containers made from plastic or metal, which is an advantage during manufacture, allowing less expensive materials to be used. This feature also adds versatility to the closure as different types of products may require containers of varying materials; i.e., a product may be impervious to plastic but may have some undesirable reaction with a metal container.

The base assembly 110 fits onto the container 210, and the lid assembly 300 snaps into the base assembly 110. The closure 100 has a perforated tamper evident strip 400 which, when in place, joins the second lid right edge 372 to the first lid left edge 354. The tamper evident strip may be attached to the two lid edges at the bottom of the lids, in the middle of the lids, at the top of the lids, or anywhere between the two lids. The tamper evident strip 400 attaches to the lid assembly 300 in a manner such that either or both lids cannot be opened without breaking that attachment.

As can be seen from the figures, a consumer would pull on the tamper evident strip pull 430 to remove the tamper evident strip 400 and thus be able to open the closure 100. It would be obvious if the tamper evident strip 400 were missing, because there would be torn perforations along the inner edges of the lids, and along the front of the lids where the strip had been torn off.

In FIG. 1, first lid 350 and second lid 370 are shown attached to base assembly 110 by means of a "living hinge" 360 and 380. This configuration is very economical, and as one factor in allowing closure tends to be molded as a single piece; however, other hinge configurations for such containers are known in the art, and any of these hinge configurations would be suitable for the present invention.

Figure 5:
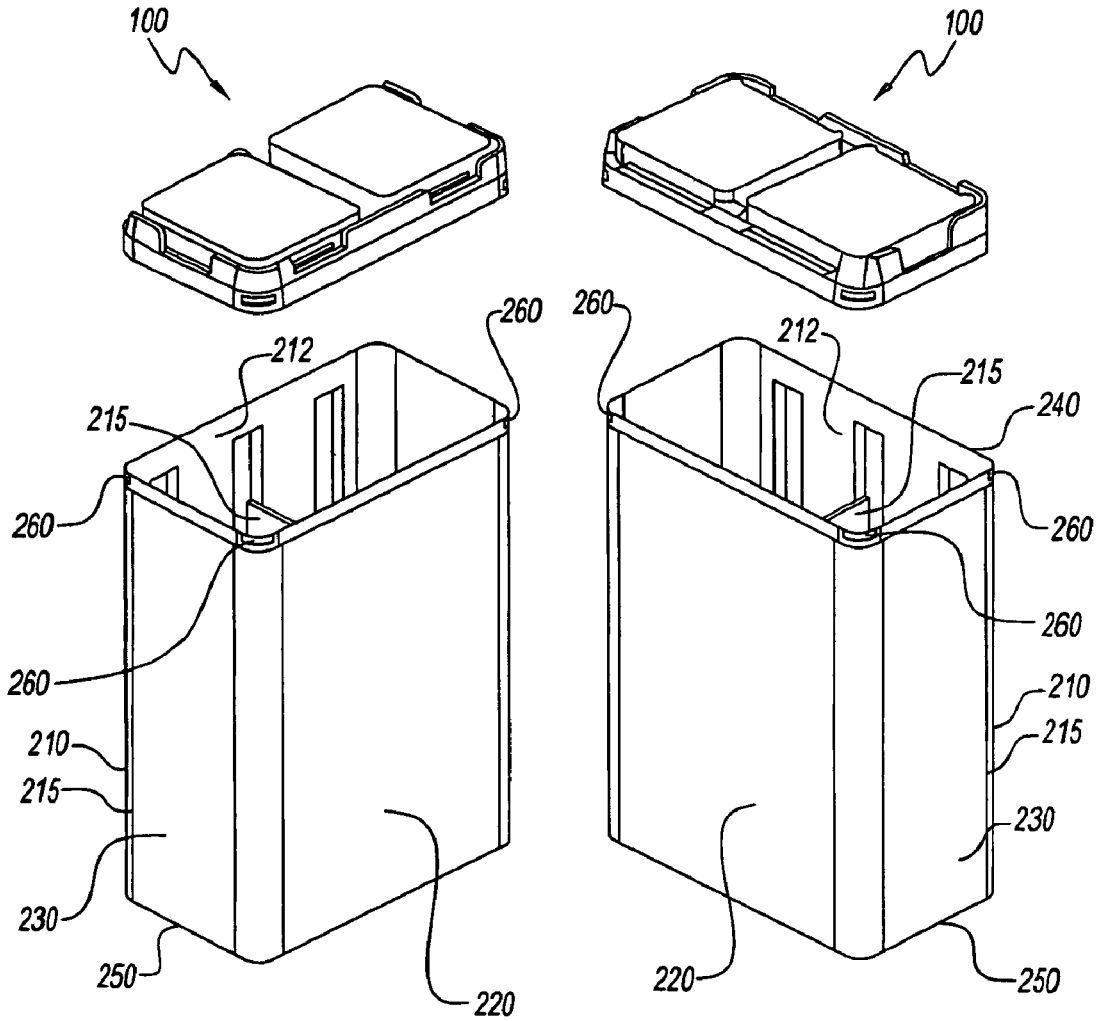
FIG. 5 is an exploded top perspective view showing the closure of the invention in use with a plastic container.

FIG. 5 shows an exploded perspective view of the container 210 and closure 100, in particular container 210, inner container wall 212, separating wall 215, container front 220, container rear 225, container side 230, container top 240, container bottom 250, container barbed hook catch 260. It is especially preferred that if the container 210 is made out of plastic, that separating wall 215 be placed substantially as shown on inner wall 212 of container 210. Separating 215 wall prevents deformation of the walls of container 210 if a user exerts too much force by squeezing container front 220 and container rear 225 too hard. In the case, the closure 100 could accidentally pop off the container. Separating wall 215 can extend from container bottom 250 up to container top 240, but preferably does not extend completely up to container top 240, as shown in the drawing. Separating wall 215 is preferably solid and molded integrally with the container, but may also be an insert slideably fitted to inner container wall 212, or welded to inner container wall 212. In the preferred embodiment, the separating wall 215 is made of the same material as the container 210, but may also be made of a different material. Finally, the separating wall 215 may be solid, or have holes or cutouts.

FIG. 5 also shows that container 210 has container barbed hook catch 260 at each top corner of the container. Barbed hook catch 260 is proximately located to mate with barbed hook inlet 330 of closure 100. In this configuration, the container is also tamper evident; if an intruder takes off the closure 100, then barbed hook inlet 330 of the closure will break, and the evidence of this break will alert the consumer that an intruder has attempted to take the closure off the container.

Figure 6:
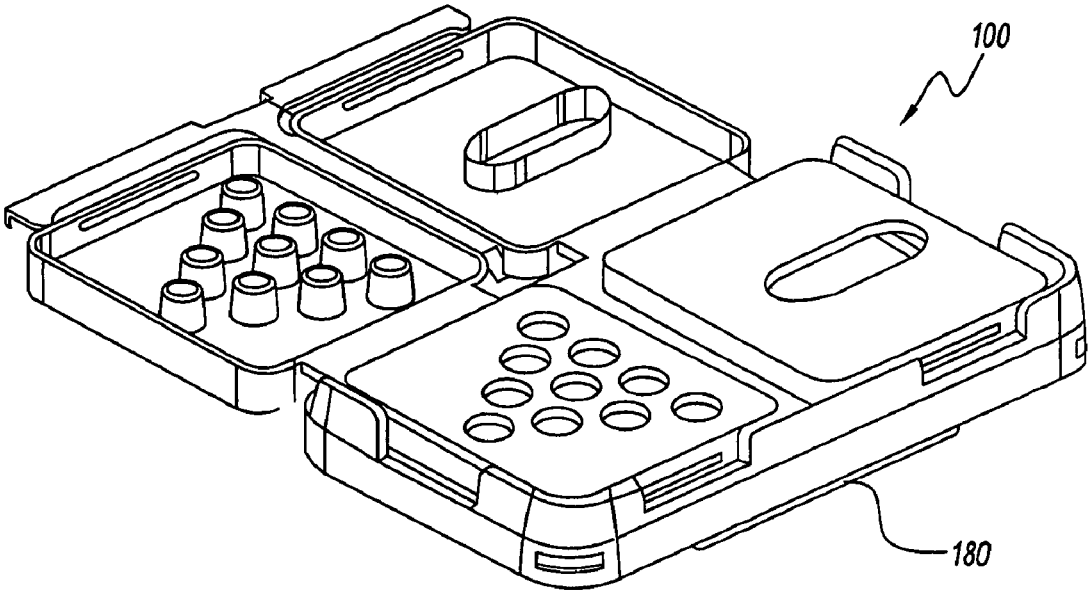
FIG. 6. is a top perspective view of the invention especially adapted for use with a metal container.

FIG. 6 shows the closure adapted for use on a metal container. It has substantially the same parts as identified in FIG. 1, however, barbed hook inlet 330 is not necessary. In addition, the closure as adapted for a metal container preferably has barbed hook edge 190 (not shown). In another preferred embodiment, closure 100 has base support edge 180.

Figure 7:
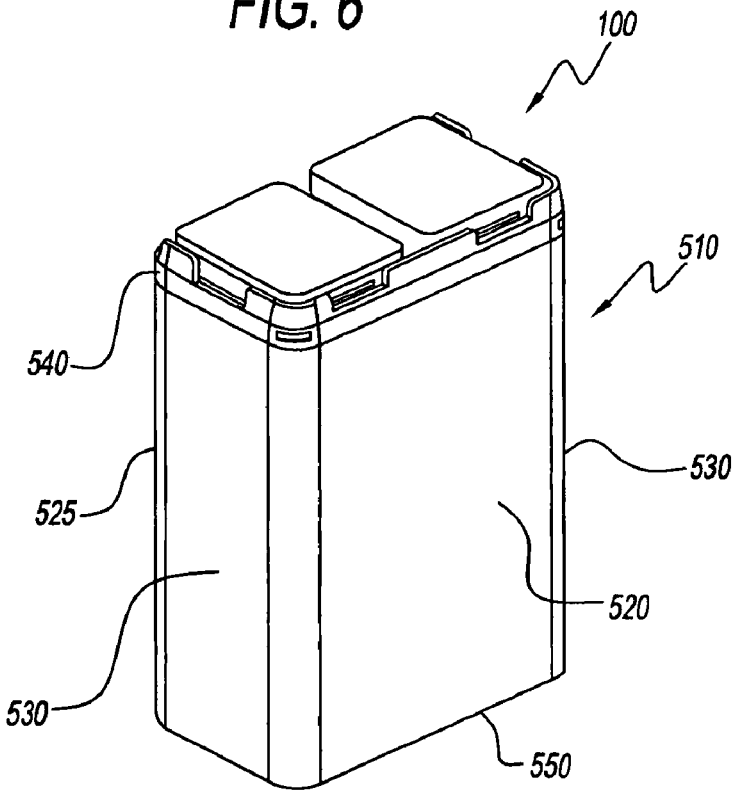
FIG. 7 is a top perspective view of the invention disposed on a metal container.

FIG. 7 shows the closure 100 of FIG. 6 disposed on metal container 510. Metal container 510, metal container front 520, metal container rear 525, metal container side 530, metal container top 540, metal container bottom 550, metal container hooked edge 560 (not shown). The metal container can be any dimension, but is likely to be 40 cm by 70 cm. The metal can be any metal, but is preferably tin or a tin alloy.

Figure 8:
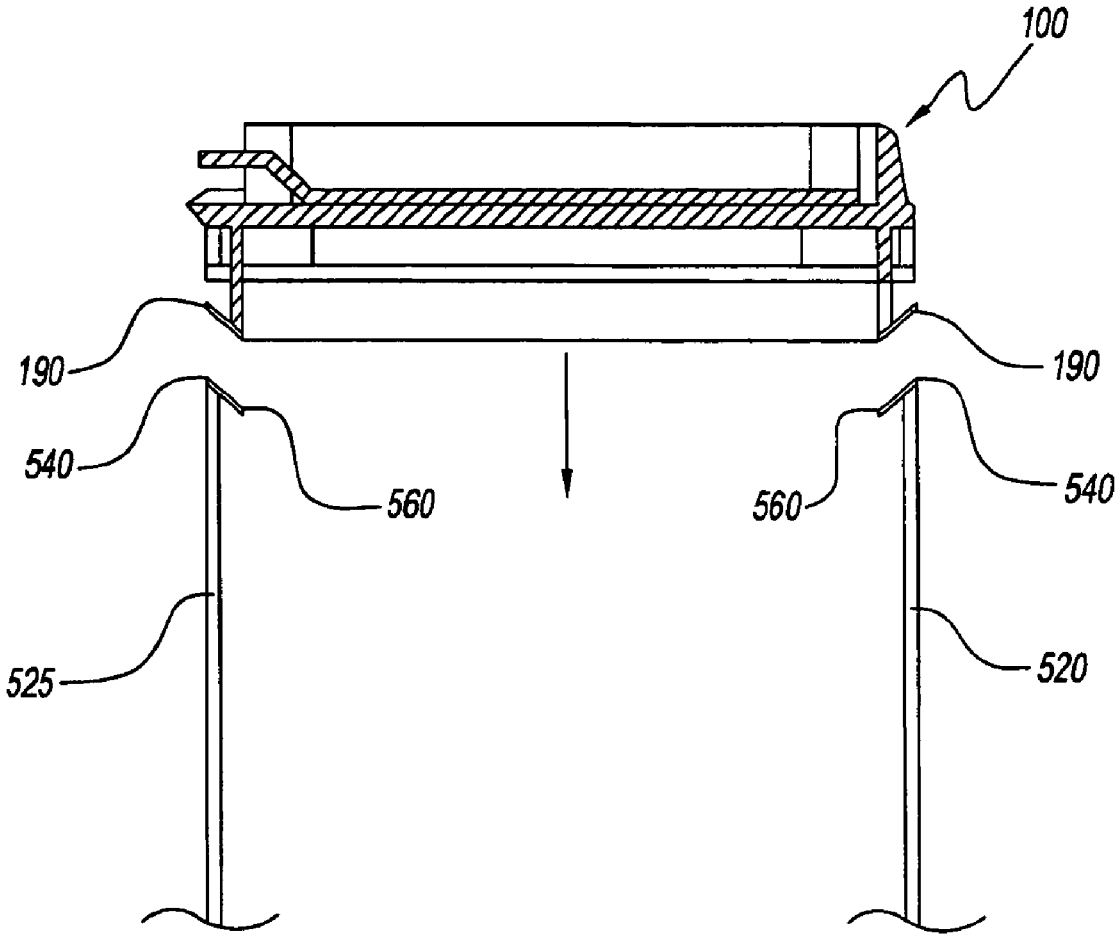
FIG. 8 is a cross section of the closure being attached to a metal container.
Figure 9:
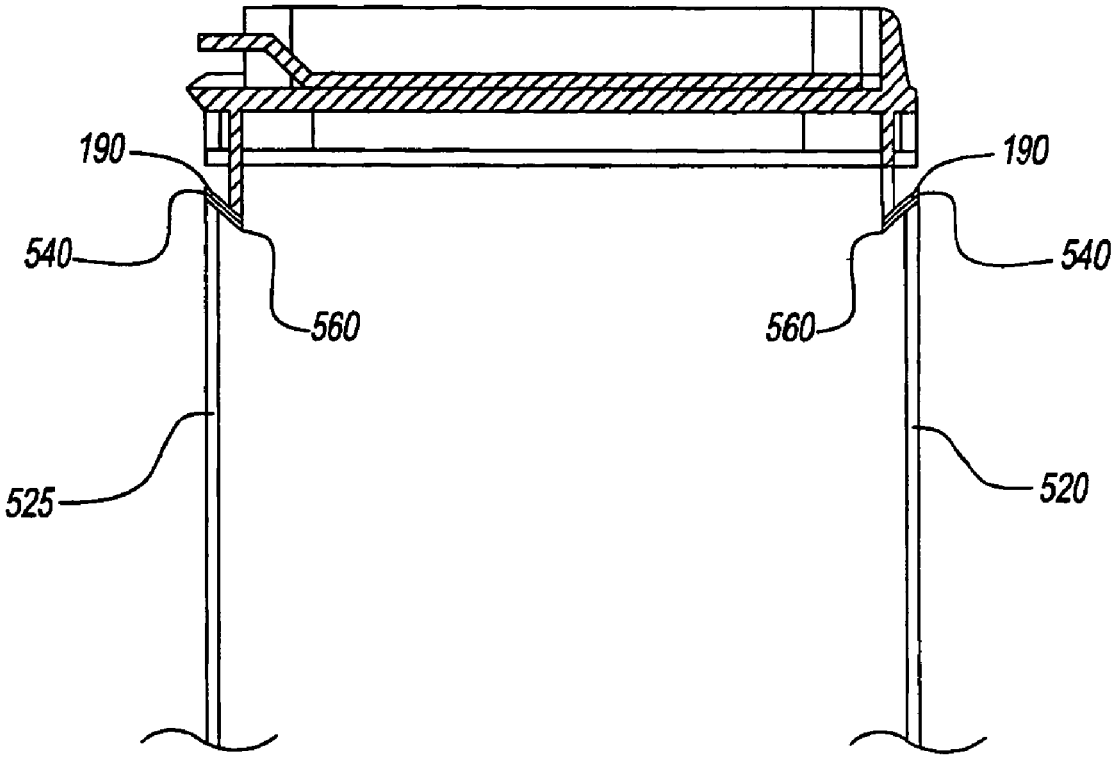
FIG. 9 is a cross section of the closure after being attached to a metal container.

FIGS. 8 and 9 show the metal container 510 and closure 100. The closure 100 is adapted for the metal container and has base hooked edge 190, which may extend around the entire inside of base assembly 110, although, in other embodiments it may extend around portions thereof. Extending around the perimeter at metal top 540 is metal container hooked edge 560. When closure 100 is placed on metal container 510, metal container hooked edge 560 hooks into base hooked edge 190 and the closure 100 is secured to the metal container. 510. It is understood that other methods of connecting closure 100 and metal container 510 are within the scope of this invention, and include any number of methods for joining the closure and container that are already known in the art.

Of significance is the base support edge 180. This feature is especially important for metal containers, as the support pushes against the metal container top 540, and reduces the tendency of the container walls to collapse if too much pressure is applied by the consumer.

The container and closure 100 may be assembled in any method. The closure 100 may be attached to the container 210 by, but not limited to, adhering the two together, joining them together by heat fusion, or joining them by mechanically bonding through, but not limited to, crimping or using a hook and eye or hook and groove type of feature (a hook on the closure fits a groove on the container as described above).

Although this invention has been described with a certain degree of particularity, it is to be understood that the present disclosure has been made only by way of illustration and that numerous changes in the details of construction and arrangement of parts may be resorted to without departing from the spirit and the scope of the invention.

We claim:

1. An article of manufacture, comprising:

a closure having a lid assembly and a base assembly;

the base assembly having a base wall having front, left and right sides, said base wall front side further having an inside surface;

the lid assembly having at least a first lid and a second lid hinged to the base assembly, wherein each lid has a left side, a right side, and a bottom edge;

a tamper evident strip having a center strip, a pull connected to the center strip, where the center strip is perpendicularly oriented to the front of the container, and an angled tear strip secured to the center strip, the center strip being breakably attached to the left side of the first lid and the right side of the second lid, the angled tear strip being attached to the bottom edge of each lid, and having a flex point, a first portion, and a second portion, the flex point allowing the first portion and second portion of the angled tear strip to bend up and be held flush between the inside surface of the base wall and a front edge of the lid, wherein said angled tear strip covers the top of each lid when the lids are closed but before the angled tear strip is removed by a user.

2. The article of claim 1, wherein the center strip has a front portion and a back portion, and the pull is located at the front portion.

3. The article of claim 1, wherein the center strip has a front portion and a back portion, and the pull is located at the back portion.

4. The article of claim 1, wherein the base assembly is disposed on a rectangular container.

5. The article of claim 4, wherein the base assembly has a base hooked edge, and said container has a barbed hook catch which conforms to said base hooked edge.

6. The article of claim 5, wherein the container is metal.

7. The article of claim 4, wherein the container is plastic.

8. The article of claim 7, wherein the closure has a barbed hook inlet, and the container has corresponding hooked edge.

9. The article of claim 8, wherein the container has a separating wall.

10. The article of claim 1, wherein the base assembly has at least one top surface, the top surface having material removed to form at least one hole.

11. The article of claim 10, wherein the hole has a width of less than 3 mm.

12. The article of claim 10, wherein the base assembly has a top surface, and the top surface has a pouring hole and has at least two sprinkling holes, and at least one sprinkling hole is about 30 percent larger than the other sprinkling hole or holes.

13. The article of claim 1, wherein the base assembly has a catch, and said lid has a capture lip conforming to the shape of the catch of the base assembly, so that when the lid is closed, said lid is releasabley held to said base assembly.

14. The article of claim 1, wherein said hinge is a flexible hinge.

15. The article of claim 1, wherein each lid has a lid lift.

16. The article of claim 1, where said closure is made of poly propylene and the closure has been injection molded.

* * * * *